US010059109B2

(12) United States Patent
Shimazu et al.

(10) Patent No.: US 10,059,109 B2
(45) Date of Patent: Aug. 28, 2018

(54) LIQUID EJECTING APPARATUS

(71) Applicant: SEIKO EPSON CORPORATION, Tokyo (JP)

(72) Inventors: Masamitsu Shimazu, Shiojiri (JP); Shunichi Hizawa, Matsumoto, PA (US)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/385,640

(22) Filed: Dec. 20, 2016

(65) Prior Publication Data

US 2017/0182765 A1 Jun. 29, 2017

(30) Foreign Application Priority Data

Dec. 24, 2015 (JP) ..... 2015-251807

(51) Int. Cl.
*B41J 2/165* (2006.01)

(52) U.S. Cl.
CPC ..... *B41J 2/16508* (2013.01); *B41J 2/16523* (2013.01); *B41J 2/16526* (2013.01); *B41J 2002/16573* (2013.01)

(58) Field of Classification Search
None
See application file for complete search history.

(56) References Cited

U.S. PATENT DOCUMENTS 9,290,017 B2 * 3/2016 Yoshida ..... B41J 2/16505

FOREIGN PATENT DOCUMENTS

| | | |
|---|---|---|
| JP | 2005-246698 | 9/2005 |
| JP | 2009-039982 | 2/2009 |
| JP | 2014-188860 | 10/2014 |

OTHER PUBLICATIONS

Machine Translation of JP-2010105348A, Shusa M, "Inkjet recording device", May 13, 2010, Canon KK, Paragraphs [0012-0016, 0019-0038].*

* cited by examiner

*Primary Examiner* — Lisa M Solomon
(74) *Attorney, Agent, or Firm* — Workman Nydegger

(57) ABSTRACT

A liquid ejecting apparatus includes a liquid ejecting head configured to eject liquid; a control unit that makes the liquid ejecting head execute a plurality of types of preliminary ejection, which are ejection of liquid onto a medium and ejection of liquid onto an area outside the medium; and a plurality of receiving portions configured to receive liquid ejected by preliminary ejection, wherein the control unit changes the receiving portion that receives liquid ejected by preliminary ejection depending on the types of preliminary ejection.

9 Claims, 4 Drawing Sheets

LIQUID EJECTING APPARATUS

BACKGROUND

1. Technical Field

The present invention relates to liquid ejecting apparatuses such as printers.

2. Related Art

Liquid ejecting apparatuses include an ink jet printer that performs printing by ejecting ink from nozzles. In such a printer, preliminary ejection, which is ejection for discharging ink in the nozzle, may be performed in order to prevent or eliminate clogging of nozzles. Moreover, as disclosed in JP-A-2009-39982, the printer may be configured to receive ink ejected by preliminary ejection in an ink receiving portion when ink is ejected onto an area outside a paper sheet during printing performed to the edge of the paper sheet without leaving a margin, and to suction the received ink from the ink receiving portion so as to store in a waste ink tank.

In preliminary ejection, a discharge amount of liquid varies depending on the purpose or timing of ejection. Accordingly, if every preliminary ejection is performed to the ink receiving portion and the suctioning is performed in the same manner every time, a problem arises that the suctioning of ink may be insufficient or excessive. In particular, when suctioning of ink is insufficient, ink ejected by preliminary ejection may not be fully received by the ink receiving portion.

This problem is not limited to printers that performs printing by ejecting ink. In general, the same problem may occur in liquid ejecting apparatuses that eject liquid onto a medium and an area outside a medium.

SUMMARY

An advantage of some aspects of the invention is that a liquid ejecting apparatus that can appropriately receive liquid ejected onto an area outside the medium is provided.

The following describes means for solving the above problem and the advantageous effect thereof.

According to an aspect of the invention, a liquid ejecting apparatus that solves the problem includes a liquid ejecting head configured to eject liquid; a control unit that makes the liquid ejecting head execute a plurality of types of preliminary ejection, which are ejection of liquid onto a medium and ejection of liquid onto an area outside the medium; and a plurality of receiving portions configured to receive liquid ejected by preliminary ejection, wherein the control unit changes the receiving portion that receives liquid ejected by preliminary ejection depending on the types of preliminary ejection.

With this configuration, since a plurality of receiving portions configured to receive liquid ejected by preliminary ejection are provided, the liquid ejected onto an area outside the medium can be appropriately received by changing the receiving portion that receives liquid ejected by preliminary ejection depending on the types of preliminary ejection.

In the above liquid ejecting apparatus, the plurality of receiving portions include a first receiving portion that communicates with a waste liquid containing chamber configured to contain waste liquid and a second receiving portion having an area open to an atmosphere larger than that of the first receiving portion.

With this configuration, the first receiving portion can repeatedly receive liquid since the liquid received by the first receiving portion is introduced into the waste liquid containing chamber as waste liquid. Further, the second receiving portion can repeatedly receive liquid by promoting evaporation of the received waste liquid since the second receiving portion has an area open to the atmosphere which is larger than that of the first receiving portion. Since the amount of waste liquid introduced into the waste liquid containing chamber can be decreased by the amount of waste liquid received by the second receiving portion, the waste liquid containing chamber can last longer period of time or can be reduced in size.

The above liquid ejecting apparatus includes a medium support disposed in a region where the liquid ejecting head ejects liquid, wherein the medium support includes the second receiving portion and a support projection which protrudes upward from the second receiving portion and serves to support the medium, and the second receiving portion is configured to receive liquid which is not received by the medium when the liquid ejecting head ejects liquid onto the medium supported by the support projection.

With this configuration, since the second receiving portion can receive liquid discharged as waste liquid by preliminary ejection and liquid ejected onto an area outside the medium, the apparatus can be simplified compared with the case having separate receiving portions. Further, since the second receiving portion is provided on the medium support that supports the medium, the apparatus can be prevented from increasing in size.

In the above liquid ejecting apparatus, the plurality of types of preliminary ejection include a post discharge preliminary ejection that is performed after a maintenance operation which allows liquid to be discharged from the liquid ejecting head into the first receiving portion, and the control unit makes the first receiving portion receive liquid ejected by preliminary ejection in the post discharge preliminary ejection.

With this configuration, since the liquid ejected by post discharge preliminary ejection is received by the first receiving portion after allowing liquid to be discharged from the liquid ejecting head to the first receiving portion, maintenance operation and post discharge preliminary ejection can be successively performed.

The above liquid ejecting apparatus includes a medium support disposed in a transportation path of the medium, wherein the medium support includes the second receiving portion and a support projection which protrudes upward from the second receiving portion and serves to support the medium, the plurality of types of preliminary ejection include an initial preliminary ejection that is performed before ejection of liquid onto a single sheet of the medium, and the control unit makes the second receiving portion receive liquid ejected by preliminary ejection in the initial preliminary ejection.

With this configuration, since the liquid ejected by preliminary ejection is received by the second receiving portion disposed on the medium support in the initial preliminary ejection, initial preliminary ejection and ejection of liquid onto a medium can be successively performed by ejecting liquid onto a medium transported on the support projection subsequently to the initial preliminary ejection.

In the above liquid ejecting apparatus, the control unit sequentially changes a region where liquid is received in the second receiving portion when liquid ejected by preliminary ejection is received in the second receiving portion.

With this configuration, since the region where liquid is received is sequentially changed in the second receiving portion when preliminary ejection is performed to the second receiving portion, receiving positions of liquid in the second receiving portion can be distributed to thereby efficiently promote evaporation.

In the above liquid ejecting apparatus, the control unit includes a memory that stores an accumulated amount of liquid received by each of a plurality of regions in the second receiving portion and changes a region that receives liquid in the second receiving portion depending on the accumulated amount.

With this configuration, when liquid is received by the second receiving portion, the region that receives liquid can be changed depending on the accumulated amount of liquid which has been received. Accordingly, receiving positions of liquid in the second receiving portion can be distributed to thereby efficiently promote evaporation.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of a liquid ejecting apparatus will be described. The liquid ejecting apparatus is an ink jet printer that performs recording (printing) by ejecting ink which is an example of liquid onto a medium such as a paper sheet.

Figure 1:
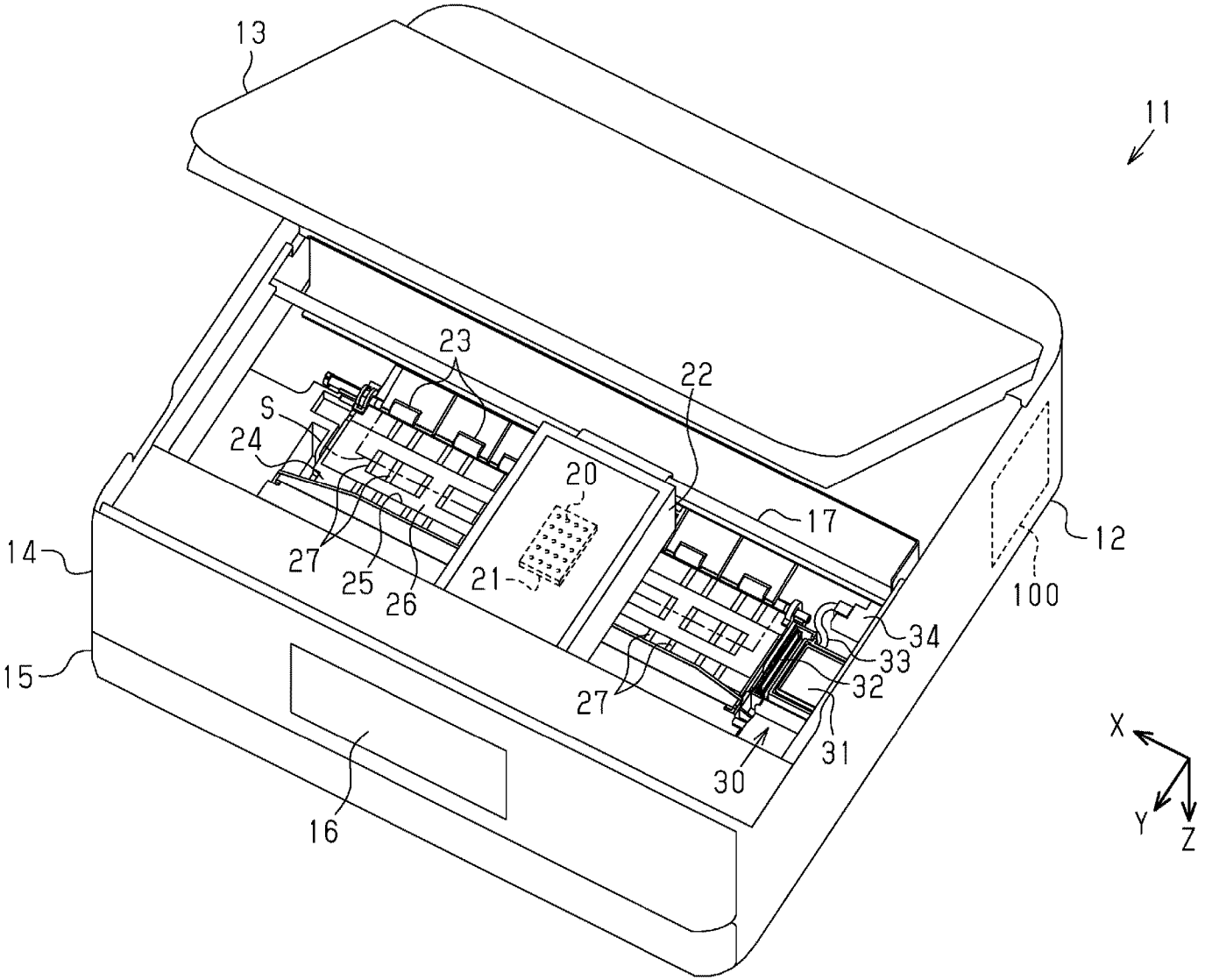
FIG. 1 is a perspective view of a liquid ejecting apparatus according to one embodiment.

As shown in FIG. 1, a liquid ejecting apparatus 11 includes a rectangular box-shaped housing 12, and an openable lid 13, an openable panel 14 and an openable cover 15 which are rotatably mounted on the housing 12. The openable lid 13 is mounted on an upper side of the housing 12 with a rotation shaft of the openable lid 13 being located close to a rear side of the housing 12. Accordingly, the openable lid 13 is configured to rotate about the rear end by a predetermined angle so as to move between a close position shown in FIG. 2 and an open position shown in FIG. 1.

Figure 2:
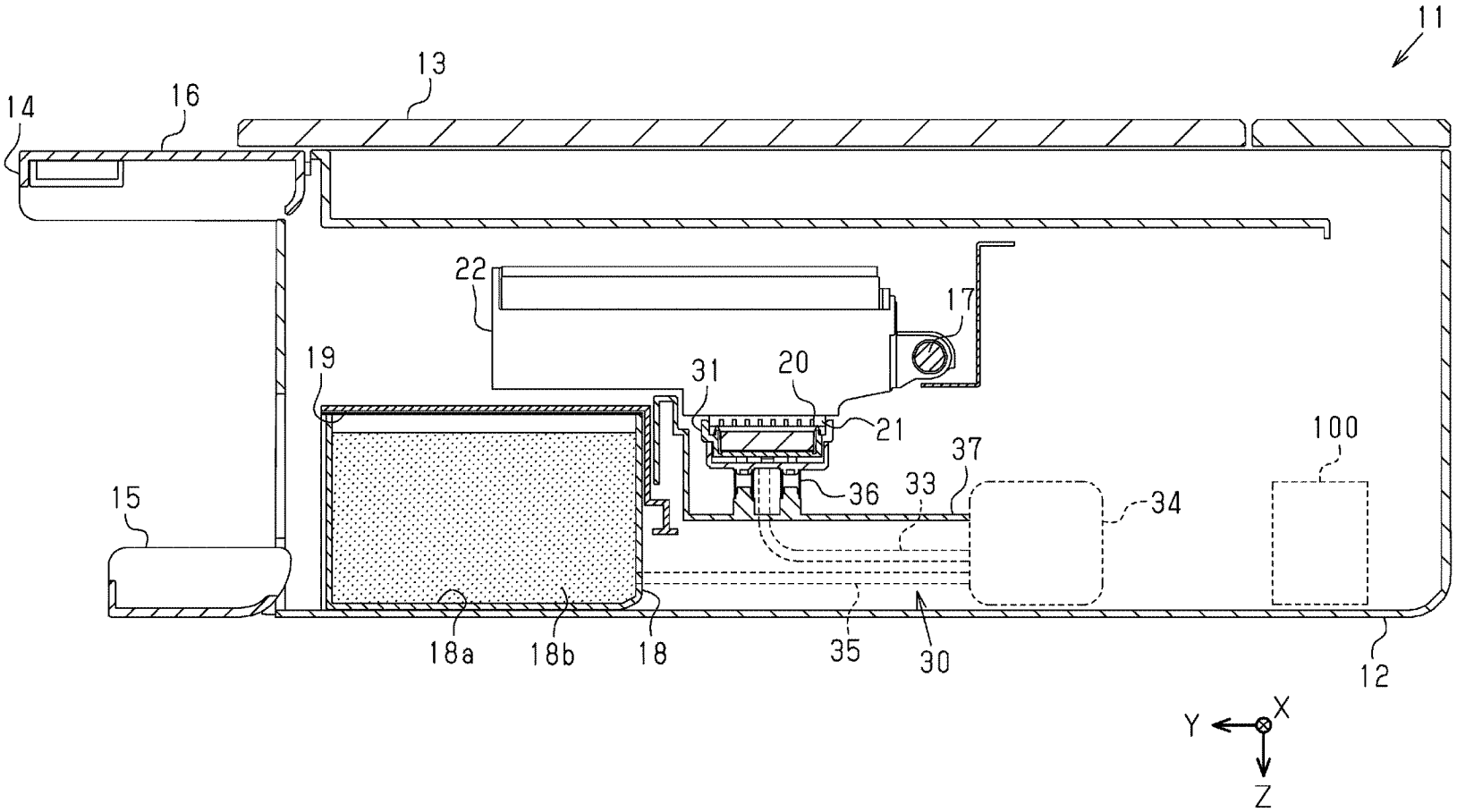
FIG. 2 is a cross sectional view of the liquid ejecting apparatus of FIG. 1.

The openable panel 14 mounted on a front side of the housing 12 is configured to rotate about the upper end by substantially 90 degrees so as to move between a close position shown in FIG. 1 and an open position shown in FIG. 2. The openable panel 14 is provided with a panel 16 for manipulating the liquid ejecting apparatus 11 or for displaying an operation state of the liquid ejecting apparatus 11.

The openable cover 15 mounted on the front side of the housing 12 under the openable panel 14 is configured to rotate about the lower end by substantially 90 degrees so as to move between a close position shown in FIG. 1 and an open position shown in FIG. 2.

The housing 12 houses a liquid ejecting head 21 having a plurality of nozzles 20 that can eject liquid, a carriage 22 that reciprocates while holding the liquid ejecting head 21, a transportation roller 23 that transports a medium S, a medium support 24 disposed in a transportation path of the medium S, a guide shaft 17, and a maintenance mechanism 30 that performs maintenance of the liquid ejecting head 21. The liquid ejecting apparatus 11 further includes a control unit 100 disposed at any position in the housing 12. The control unit 100 controls the operation of components including the liquid ejecting head 21 and the maintenance mechanism 30.

The guide shaft 17 extends in a movement direction X which intersects with (in this embodiment, which is perpendicular to) a gravity direction Z. The liquid ejecting head 21 reciprocates in the movement direction X while being held by the carriage 22 when controlled by the control unit 100. Further, the transportation roller 23 transports the medium S in a transfer direction Y which intersects with (in this embodiment, which is perpendicular to) both the gravity direction Z and the movement direction X when controlled by the control unit 100. Moreover, the liquid ejecting head 21 performs printing (recording) by ejecting liquid onto the medium S through the nozzles 20 when controlled by the control unit 100.

The medium support 24 and the maintenance mechanism 30 are disposed side by side in the movement direction X of the liquid ejecting head 21. Moreover, the maintenance mechanism 30 includes a cap 31 which serves as a first receiving portion disposed on one end in the movement direction X, a wiper 32 disposed between the cap 31 and the medium support 24 in the movement direction X, and a suction pump 34 connected to the cap 31 via the suction tube 33.

In this embodiment, a position where the cap 31 is located in the movement area of the liquid ejecting head 21 in the movement direction X is referred to as a home position of the liquid ejecting head 21, and an end on which the cap 31 is located in the movement direction X in the movement area is referred to as a home end. Further, an end opposite from the home end in the movement area is referred to as a non-home end.

The medium support 24 preferably includes a recess 25 which serves as a second receiving portion, an absorbing sheet 26 which can absorb liquid stored in the recess 25, and support projections 27 which protrude upward from the recess 25 and the absorbing sheet 26 so as to support the medium S. A plurality of support projections 27 may be arranged side by side in each of the movement direction X and the transfer direction Y.

The liquid ejecting apparatus 11 of the present embodiment performs printing on a plurality of types of the media S having different sizes (length in the movement direction X and the transfer direction Y). When transported, the medium S is aligned with the non-home end regardless of the size of the medium S so that the ends of the medium S in the movement direction X are positioned above the absorbing sheet 26. Accordingly, when the liquid ejecting head 21 ejects liquid onto the medium S supported by the support projection 27 in marginless printing that performs printing to the edge of the medium S without leaving a margin, the liquid which is not received by the medium S can be received by the second receiving portion, the recess 25. That is, the medium support 24 is disposed in a region where the liquid ejecting head 21 ejects liquid onto the medium S and the recess 25 receives liquid ejected onto an area outside the medium S in marginless printing.

As shown in FIG. 2, the suction pump 34 that forms the maintenance mechanism 30 is connected to a waste liquid container 18 mounted on a mounting section 19 via a discharge tube 35. Further, the cap 31 is supported by a support frame 37 in the housing 12 via a bias member 36. The cap 31 is configured to be movable by a movement mechanism, which is not shown in the figure, between a released position which is spaced from the liquid ejecting head 21 and a capping position (position shown in FIG. 2) at which the cap 31 is forced to be in contact with the liquid ejecting head 21 by a biasing force of the bias member 36 while surrounding the nozzles 20.

In order to keep a good ejection performance of the liquid ejecting head 21, the maintenance mechanism 30 performs a maintenance operation of the liquid ejecting head 21 by control of the control unit 100.

For example, the liquid ejecting head 21 is positioned at the home position when the liquid ejecting head 21 does not eject liquid during the power off. Then, the cap 31 is moved to a capping position for capping so as to form a closed space to which the nozzles 20 are open. This capping prevents occurrence of clogging of the nozzle 20 due to drying.

The maintenance mechanism 30 performs suction cleaning to forcibly discharge liquid in the liquid ejecting head 21 through the nozzles 20 by actuating the suction pump 34 in the state of capping. Further, the maintenance mechanism 30 can also perform pressurized cleaning to discharge liquid through nozzles 20 by pressurizing liquid in the liquid ejecting head 21.

Such cleaning operations including suction cleaning and pressurized cleaning may be performed during an initial filling in which a flow path to the nozzle 20 is filled with liquid, or alternatively, as a manual cleaning which is carried out by a user to eliminate ejection failure of liquid due to clogging of the nozzles 20 or the like. Furthermore, cleaning can be performed on a regular basis with an interval of a predetermined period of time.

After cleaning, the cap 31 is moved to the released position so that the inside of the cap 31 is exposed to the atmosphere. Then, the suction pump 34 is again actuated for empty suctioning to thereby suction waste liquid remaining in the cap 31. The liquid discharged from the liquid ejecting head 21 by cleaning and empty suctioning, which is waste liquid containing air bubbles and solute component of thickened liquid, is received in the waste liquid containing chamber 18*a* formed in the waste liquid container 18 via the discharge tube 35. The waste liquid container 18 may be provided with a waste liquid absorber 18*b* in the waste liquid containing chamber 18*a* so as to absorb and hold waste liquid.

The waste liquid container 18 is preferably configured to be replaceable by being detachably mounted to the housing 12. However, the liquid ejecting apparatus 11 may include a waste liquid containing chamber which is unremovably incorporated in the housing 12 so that waste liquid is introduced into the waste liquid containing chamber.

After cleaning, which is a maintenance operation that discharges liquid from the liquid ejecting head 21 to the cap 31 which is the first receiving portion, wiping is preferably performed since liquid droplets are attached around the nozzles 20 of the liquid ejecting head 21.

Figure 3:
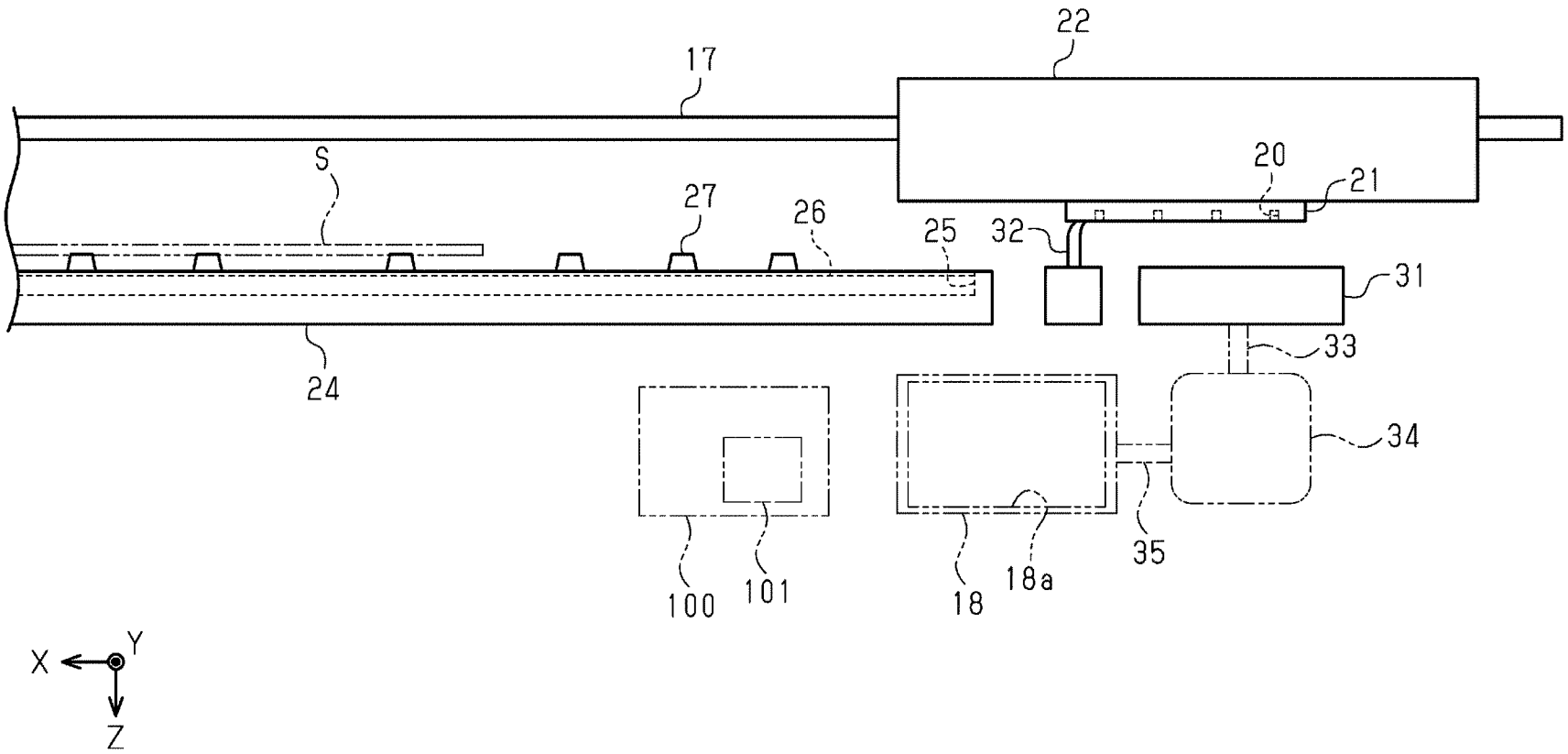
FIG. 3 is a front view which schematically shows a movement area of a liquid ejecting head.

As shown in FIG. 3, wiping is a maintenance operation that wipes off liquid droplets or dusts attached around the nozzles 20 of the liquid ejecting head 21 by using the wiper 32. The wiper 32 is preferably configured to be movable between a wiping position at which the wiper 32 can be in contact with the moving liquid ejecting head 21 (position shown in FIG. 3) and a retracted position at which the wiper 32 is not in contact with the moving liquid ejecting head 21. In this case, when the wiper 32 is at the wiping position, the liquid ejecting head 21 can perform wiping by moving from the home position in the movement direction X.

Further, the control unit 100 makes the liquid ejecting head 21 execute a plurality of types of preliminary ejection, which is ejection of liquid onto an area outside the medium S (also referred to as flushing or empty ejection), as a maintenance operation. The control unit 100 changes the receiving portion that receives liquid ejected by preliminary ejection depending on the types of preliminary ejection. The liquid ejecting apparatus according to the present embodiment includes a plurality of receiving portions, that is, the cap 31 as the first receiving portion that communicates with the waste liquid containing chamber 18*a* which can store waste liquid and the recess 25 as the second receiving portion. The waste liquid received in the recess 25 in preliminary ejection is absorbed and held by the absorbing sheet 26.

The following explains a plurality of types of preliminary ejection that the control unit 100 makes the liquid ejecting head 21 execute, changing of the receiving portion that receives liquid ejected by preliminary ejection, and an effect of the changing.

First, a plurality of types of preliminary ejection include an initial preliminary ejection that is performed before ejection of liquid onto a single medium S. The initial preliminary ejection is performed before printing of the medium S when a single medium S is printed by a single printing operation. Alternatively, when a plurality of media S are successively printed by a single printing operation, the initial preliminary ejection is performed before printing of the first sheet of the medium S, and in addition to that, the initial preliminary ejection may also be performed every time after printing of one sheet is finished and before printing of the next sheet starts (that is, inbetween the paper sheets).

Figure 4:
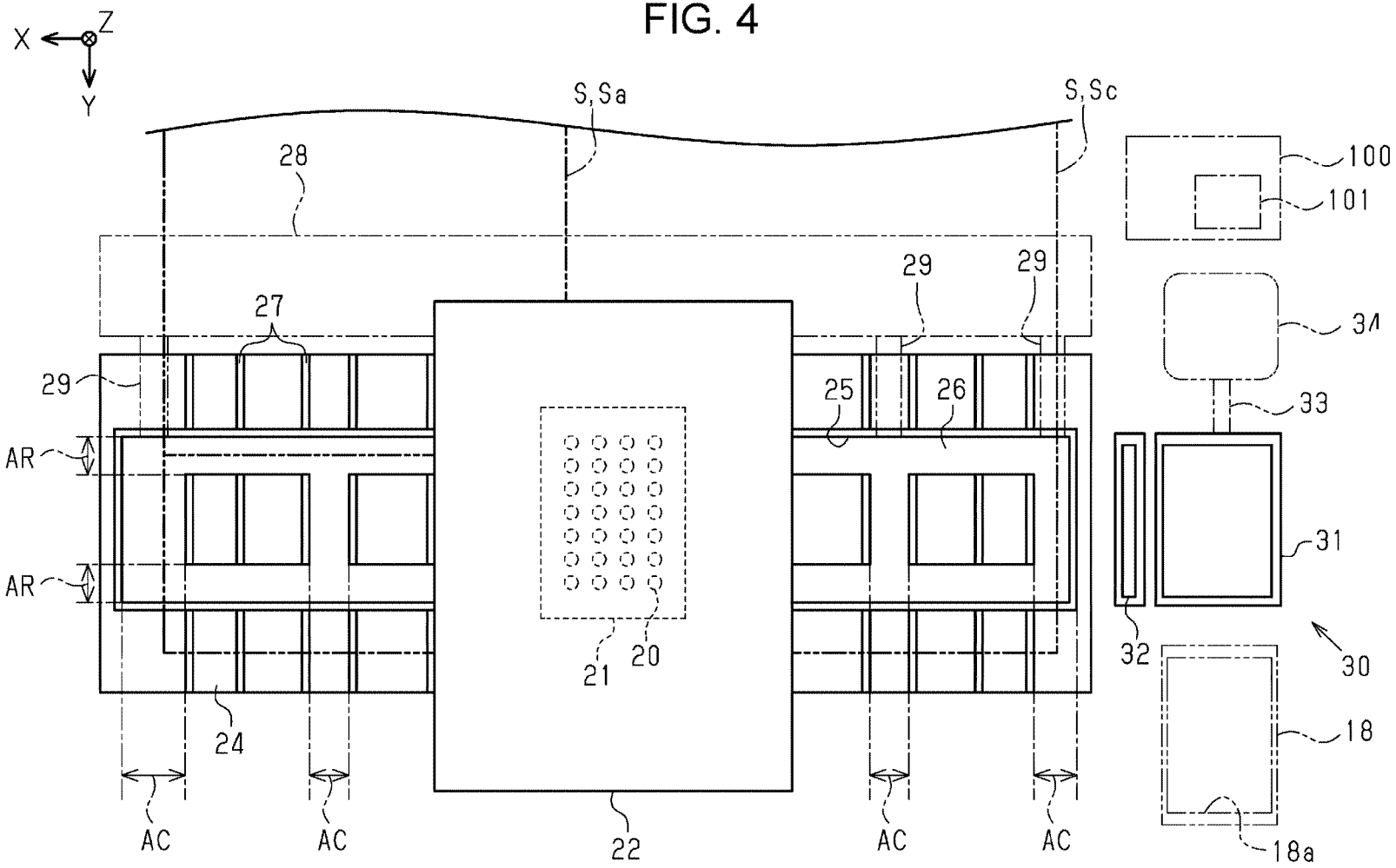
FIG. 4 is a Plan view which schematically shows the movement area of the liquid ejecting head.

As shown in FIG. 4, the recess 25 of the medium support 24 includes a plurality of column regions AC which are arranged in the movement direction X side by side with the support projections 27, and line regions AR extending in the movement direction X and arranged in the transfer direction Y side by side with the support projections 27. When printing is performed to the edge of the medium S in the movement direction X without leaving a margin, the liquid ejected onto an area outside the edge is received in the column regions AC. Further, when printing is performed to the edge of the medium S in the transfer direction Y without leaving a margin, the liquid ejected onto an area outside the edge is received in the line regions AR.

Here, the liquid received in the cap 31 can be transferred to the waste liquid containing chamber 18*a* by driving the suction pump 34. Accordingly, whenever the waste liquid containing chamber 18*a* has an empty space, the cap 31 can receive liquid. On the other hand, the liquid received in the recess 25 is absorbed by the absorbing sheet 26. However, since the amount that can be absorbed is smaller than that can be received in the waste liquid containing chamber 18*a*, liquid needs to be received with an interval while promoting evaporation of the received liquid in order to avoid overflow of the waste liquid from the recess 25.

Moreover, while an opening of the recess 25 is constantly open to the atmosphere, an opening of the cap 31 is not open to the atmosphere at the time of capping. Accordingly, the waste liquid received by the recess 25 is more easily evaporated than the waste liquid received by cap 31. In order to promote evaporation of the received liquid (waste liquid), the recess 25 which is the second receiving portion preferably has an area open to the atmosphere larger than that of the cap 31 which is the first receiving portion.

The amount of liquid received by the recess 25 decreases as it is evaporated. On the other hand, since the waste liquid stored in the waste liquid containing chamber 18*a* is not easily evaporated, a large portion of the waste liquid suctioned from the cap 31 is stored in the waste liquid containing chamber 18*a*. Accordingly, the remaining capacity of the waste liquid containing chamber 18*a* can be reserved by receiving the liquid discharged by preliminary ejection in the recess 25.

Moreover, considering control of the control unit 100, it is not preferable to move the liquid ejecting head 21 only for changing the receiving position of liquid since it causes complicated control or requires time for the movement. For this reason, in selecting the receiving position of liquid, it is advantageous if preliminary ejection is performed in coordination with the operation performed before or after the preliminary ejection, or that preliminary ejection is performed at a position close to the position where the operation before or after the preliminary ejection is performed.

Accordingly, for initial preliminary ejection, it is preferable that the control unit 100 makes the recess 25, which is the second receiving portion, receive liquid ejected by preliminary ejection. With this configuration, an operation of the initial preliminary ejection can be performed while moving the liquid ejecting head 21 in a similar manner to printing onto the medium S which is performed following the initial preliminary ejection. In particular, when the preliminary ejection is performed inbetween the paper sheets, preliminary ejection can be efficiently performed since the liquid ejecting head 21 is not required to move to the home position for the initial preliminary ejection.

Further, a plurality of types of preliminary ejection include a regular preliminary ejection that is performed at a predetermined timing during liquid ejection onto a single medium S. For the regular preliminary ejection, it is preferable that the control unit 100 makes the cap 31, which is the first receiving portion, receive liquid ejected by preliminary ejection.

With this configuration, the preliminary ejection may be performed while moving the liquid ejecting head 21 to the cap 31 regardless of size of the medium S, thereby avoiding complicated control. Further, regular preliminary ejection is performed more often than initial preliminary ejection. Accordingly, since a large amount of the liquid discharged by preliminary ejection is accumulated, there is a risk that enough evaporation is not possible if the liquid is received by the recess 25. In particular, since the liquid ejected onto an area outside the edge of the medium S in the movement direction X is received by the column regions AC in marginless printing, it is not preferable to use the same column regions AC in regular preliminary ejection.

Further, the media S (Sa, Sc) of different sizes are transported while being aligned with the non-home end. This causes the amount of liquid received in the column region AC located on the non-home end in the movement direction X during marginless printing to become larger than the amount received in the remaining column regions AC.

As described above, in a plurality of column regions AC, the amount of liquid received in marginless printing may be different from one another. Accordingly, when liquid is ejected onto a plurality of media S, the control unit 100 may allow the region where the liquid discharged in initial preliminary ejection is received to be sequentially changed in the recess 25. For example, initial preliminary ejection for each medium S is preferably performed to the column region AC which does not receive the liquid ejected onto an area outside the medium S in marginless printing. Alternatively, when there are a plurality of column regions AC that receive small amount of liquid ejected onto an area outside the medium S in marginless printing, initial preliminary ejection is preferably performed to these column regions AC in sequence.

Further, the control unit 100 may include a memory 101 that stores the accumulated amount of liquid received by each of a plurality of column regions AC in the recess 25 so that, when liquid is ejected onto a plurality of media S, the column region AC that receives liquid ejected by preliminary ejection in initial preliminary ejection may be changed in the recess 25 depending on the accumulated amount. For example, when marginless printing for a medium Sc having a large size is continuously performed, liquid of initial preliminary ejection is received by the column region AC in a center region that does not receive liquid ejected on an area outside the medium Sc. As a result, liquid can be uniformly absorbed by the absorbing sheet 26 by distributing the amount of liquid received in the recess 25.

Further, an another waste liquid containing portion 28 may be provided on the lower side or rear side of the medium support 24 so that waste liquid received in the recess 25 may be introduced into the waste liquid containing portion 28. In this case, it is possible to allow liquid to naturally flow from the recess 25 into the waste liquid containing portion 28. Alternatively, a porous member 29 extending from the recess 25 to the waste liquid containing portion 28 may be provided so that waste liquid in the recess 25 moves to the waste liquid containing portion 28 by means of capillarity. Further, when the porous member 29 is provided, preliminary ejection may be performed with priority or repeatedly to the column region AC located close to the porous member 29.

Further, a plurality of types of preliminary ejection include a post discharge preliminary ejection that is performed after cleaning, which is a maintenance operation that allows liquid to be discharged from the liquid ejecting head 21 to the cap 31 which is the first receiving portion.

Wiping is often performed after cleaning. In particular, when different types of liquid (for example, different colors of ink) are ejected from the liquid ejecting head 21, there is a risk that the nozzle 20 may be contaminated with the liquid of a different type from the ejected liquid if wiping is performed by using a single wiper 32. Furthermore, ejection failure may occur due to a foreign substance or air bubbles pushed into the nozzle 20 by wiping. Accordingly, preliminary ejection (post discharge preliminary ejection) is preferably performed after cleaning.

For the post discharge preliminary ejection, it is preferable that the control unit 100 makes the cap 31, which is the first receiving portion, receive liquid ejected by preliminary ejection. That is, since the liquid ejecting head 21 is located at the home position when initial filling or cleaning is performed, post discharge preliminary ejection, which is the subsequent preliminary ejection, performed to the cap 31 located at the home position can decrease the movement distance of the liquid ejecting head 21 and thus decrease the duration of maintenance operation.

Wiping is often performed after cleaning. Since the wiper 32 is positioned immediately adjacent to the home position, the liquid ejecting head 21 can return to the home position after wiping and perform preliminary ejection to the cap 31 which is at the released position. However, when a printing operation is performed subsequently to cleaning, wiping and post discharge preliminary ejection, the liquid ejecting head 21 can perform wiping while moving in the movement direction X from the home position, and then perform post discharge preliminary ejection to the recess 25 when it is moved to the medium support 24.

According to the aforementioned embodiment, the following effects can be obtained.

(1) Since a plurality of receiving portions configured to receive liquid ejected by preliminary ejection (for example, the cap 31 and the recess 25) are provided, the liquid ejected onto an area outside the medium S can be appropriately received by changing the receiving portion that receives liquid ejected by preliminary ejection depending on the types of preliminary ejection.

(2) The first receiving portion can repeatedly receive liquid since the liquid received by the cap 31 which is the first receiving portion is introduced into the waste liquid containing chamber 18*a* as waste liquid. Further, the recess 25 can repeatedly receive liquid by promoting evaporation of the received waste liquid since the recess 25 which is the second receiving portion has an area open to the atmosphere which is larger than that of the cap 31. Since the amount of waste liquid introduced into the waste liquid containing chamber 18*a* can be decreased by the amount of waste liquid received by the recess 25, the waste liquid containing chamber 18*a* can last longer period of time or can be reduced in size.

(3) Since the recess 25 which is the second receiving portion can receive liquid discharged as waste liquid by preliminary ejection and liquid ejected onto an area outside the medium S, the apparatus can be simplified compared with the case having separate receiving portions. Further, since the recess 25 which is the second receiving portion is provided on the medium support 24 that supports the medium S, the apparatus can be prevented from increasing in size.

(4) Since the liquid ejected by post discharge preliminary ejection is received by the cap 31 after allowing liquid to be discharged from the liquid ejecting head 21 to the cap 31 which is the first receiving portion, maintenance operation and post discharge preliminary ejection can be successively performed.

(5) With this configuration, since the liquid ejected by preliminary ejection is received by the recess 25 disposed on the medium support 24 in the initial preliminary ejection, initial preliminary ejection and ejection of liquid onto a medium S can be successively performed by ejecting liquid onto a medium S transported on the support projection 27 subsequently to the initial preliminary ejection.

(6) Since the region where liquid is received is sequentially changed in the recess 25 when preliminary ejection is performed to the recess 25 which is the second receiving portion, receiving positions of liquid in the recess 25 can be distributed to thereby efficiently promote evaporation.

(7) When liquid is received by the recess 25 which is the second receiving portion, the region that receives liquid can be changed depending on the accumulated amount of liquid which has been received. Accordingly, receiving positions of liquid in the recess 25 can be distributed to thereby efficiently promote evaporation.

The above embodiment may be changed as described in the following modified examples. Further, the above embodiment and the following modified examples may be combined as appropriate.

Modifications are possible in the nozzle 20 which ejects liquid, the amount of liquid ejected, and the number of times of liquid ejection depending on the types of preliminary ejection. For example, when printing is successively performed onto a plurality of media S, the nozzle 20 that has ejected liquid for printing of the preceding medium S does not eject liquid in initial preliminary ejection for the subsequent medium S. Only the nozzle 20 which has not been used for the preceding printing performs initial preliminary ejection before printing of the subsequent medium S. Accordingly, compared with the case where all the nozzles 20 always perform preliminary ejection, the amount of liquid discharged by preliminary ejection can be reduced, thereby reducing liquid consumption and reserving the remaining capacity of the receiving portion. Alternatively, for example, the nozzle 20 that has ejected liquid for printing of the preceding medium S ejects liquid in initial preliminary ejection for the subsequent medium S with the amount of liquid ejected in the initial preliminary ejection to the subsequent medium S being decreased. Accordingly, compared with the case where all the nozzles 20 always eject the same amount of liquid in preliminary ejection, the amount of liquid discharged by preliminary ejection can be reduced.

The memory 101 may store the accumulated amount of liquid which is received during preliminary ejection and cleaning by each of a plurality of receiving portions (for example, the cap 31 and the recess 25) so that the control unit 100 changes the receiving portion that receives liquid ejected by preliminary ejection depending on the accumulated amount. Then, for example, when the remaining capacity of the waste liquid containing chamber 18*a* becomes lower than a predetermined level, preliminary ejection may be performed to the recess 25 with an increased amount of liquid discharged.

The absorbing sheet 26 may not be provided in the recess 25.

The waste liquid received in the recess 25 may also be introduced into the waste liquid containing chamber 18*a* by suctioning or the like.

Another receiving portion (for example, flushing box) that is configured to receive liquid discharged by preliminary ejection onto a region close to the non-home end with respect to the medium support 24 may be provided in the movement area of the liquid ejecting head 21. In this case, during regular preliminary ejection and the like, preliminary ejection can be performed not only in a path back to the home position, but also in a returning path from the home position to the non-home end.

The medium S may be transported while being aligned with the home end, or alternatively, may be transported with the center of the medium S being aligned with the center of the medium support 24.

The memory 101 of the control unit 100 may store the accumulated amount of liquid received by the recess 25 during preliminary ejection and the accumulated amount of waste liquid stored in the waste liquid containing chamber 18*a* so that the receiving portion that performs preliminary ejection is changed depending on the accumulated amount. Accordingly, the receiving capacity of all the receiving portions can be efficiently used.

Liquid ejected by the liquid ejecting head 21 is not limited to ink, and may be a liquid material, for example, made up of particles of functional material dispersed or mixed in the liquid. For example, recording can be performed by ejecting a liquid material which contains dispersed or dissolved materials such as electrode materials and color materials (pixel materials) used for manufacturing of liquid crystal displays, electroluminescence (EL) displays and surface light-emitting displays.

The medium S is not limited to a paper sheet, and may be plastic films or thin plate-shaped materials, or fabrics used for textile printing.

The liquid ejecting apparatus 11 may be a line head printer which includes a line head having a component of a plurality of liquid ejecting heads arranged side by side so that the printing area covers the entire width of the medium S. In this case, the cap as the first receiving portion and the medium support having the second receiving portion may be configured to alternately move to a region where the line head ejects liquid.

The entire disclosure of Japanese Patent Application No. 2015-251807, filed Dec. 24, 2015 is expressly incorporated by reference herein.

What is claimed is:

1. A liquid ejecting apparatus comprising:

a liquid ejecting head configured to eject liquid;

a control unit that makes the liquid ejecting head execute ejections of liquid onto a medium and execute a plurality of types of a preliminary ejection, wherein the preliminary ejection includes an ejection of liquid into an area other than the medium; and a plurality of receiving portions configured to receive liquid ejected during execution of the preliminary ejection, the plurality of receiving portions including a first receiving portion that is provided in an area outside of a region in which the medium is transported and a second receiving portion that is provided in the region in which the medium is transported, wherein the control unit changes a receiving portion that receives ejected liquid depending on the preliminary ejection types.

2. The liquid ejecting apparatus according to claim 1, wherein the first receiving portion communicates with a waste liquid containing chamber configured to contain waste liquid, and the second receiving portion has an area open to an atmosphere larger than that of the first receiving portion.

3. The liquid ejecting apparatus according to claim 1, comprising:

a medium supporting portion disposed in a region where the liquid ejecting head ejects liquid, the medium supporting portion including the second receiving portion and a support projection which protrudes upward from the second receiving portion, the medium supporting portion serving to support the medium, wherein the second receiving portion is configured to receive liquid which is not received by the medium when the liquid ejecting head ejects liquid onto the medium supported by the support projection.

4. The liquid ejecting apparatus according to claim 1, wherein the plurality of types of preliminary ejection include a post discharge preliminary ejection that is performed after a maintenance operation which allows liquid to be discharged from the liquid ejecting head into the first receiving portion, and wherein the control unit makes the first receiving portion receive liquid ejected by preliminary ejection in the post discharge preliminary ejection.

5. The liquid ejecting apparatus according to claim 1, comprising:

a medium supporting portion disposed in a transportation path of the medium, the medium supporting portion including the second receiving portion and a support projection which protrudes upward from the second receiving portion, the medium supporting portion serving to support the medium, wherein the plurality of types of preliminary ejection include an initial preliminary ejection that is performed before ejections of liquid onto a single sheet of the medium, and wherein the control unit makes the second receiving portion receive liquid ejected by the initial preliminary ejection.

6. The liquid ejecting apparatus according to claim 1, wherein the control unit sequentially changes a region where liquid is received in the second receiving portion when liquid ejected by at least a type of the plurality of types of preliminary ejection is received in the second receiving portion.

7. The liquid ejecting apparatus according to claim 1, wherein the control unit includes a memory that stores an accumulated amount of liquid received by each of a plurality of regions in the second receiving portion and changes a region that receives liquid in the second receiving portion depending on the accumulated amount.

8. The liquid ejecting apparatus according to claim 1, wherein the second receiving portion underlies a medium transport path.

9. A liquid ejecting apparatus comprising:

a liquid ejecting head configured to eject liquid;

a control unit that makes the liquid ejecting head execute a plurality of types of preliminary ejection;

a plurality of receiving portions configured to receive liquid ejected by the plurality of types of preliminary ejection, the plurality of receiving portions including at least a first receiving portion and a second receiving portion; and a medium supporting portion disposed in a region where the liquid ejecting head ejects liquid, the medium supporting portion serving to support the medium, the medium supporting portion including the second receiving portion, wherein the second receiving portion is configured to receive liquid which is not received by the medium when the liquid ejecting head ejects liquid onto the medium supported by the support projection, and wherein the control unit changes the receiving portion that receives liquid ejected depending on the types of preliminary ejection.

* * * * *